US005321593A

United States Patent [19]

Moates

[11] Patent Number: 5,321,593

[45] Date of Patent: Jun. 14, 1994

[54] STRIP LIGHTING SYSTEM USING LIGHT EMITTING DIODES

[76] Inventor: Martin G. Moates, 1580 Elm St., San Carlos, Calif. 94070

[21] Appl. No.: 967,193

[22] Filed: Oct. 27, 1992

[51] Int. Cl.[5] ..... F21V 23/04

[52] U.S. Cl. ..... 362/251; 362/227; 362/800; 439/49; 439/605

[58] Field of Search ..... 439/49, 54, 56, 210, 439/222, 507, 514, 605, 614; 362/249, 226, 227, 806, 252, 800, 251

[56] References Cited

U.S. PATENT DOCUMENTS

| | | | |
|---|---|---|---|
| 2,312,181 | 2/1943 | Matthews | 439/56 |
| 3,551,723 | 12/1970 | Van Groningen | 362/227 |
| 4,164,008 | 8/1979 | Miller et al. | 362/103 |
| 4,173,035 | 10/1979 | Hoyt | 362/249 |
| 4,231,079 | 10/1980 | Heminover | 362/800 |
| 4,263,640 | 4/1981 | Altman | 362/252 |
| 4,628,421 | 12/1986 | Saar | 362/249 |
| 4,908,743 | 3/1990 | Miller | 362/238 |
| 4,950,958 | 8/1990 | Lin | 315/185 R |
| 4,997,196 | 3/1991 | Wood | 280/87.042 |
| 5,027,037 | 1/1991 | Wei | 315/200 A |
| 5,095,413 | 3/1992 | Goldberg | 362/249 |
| 5,107,408 | 4/1992 | Vernondier | 439/210 |
| 5,128,843 | 7/1992 | Guritz | 362/800 |

OTHER PUBLICATIONS

"Tokistar Lighting Systems", Tokistar Lighting Inc., 5 pages, no date.

*Primary Examiner*—Ira S. Lazarus
*Assistant Examiner*—Alan B. Cariaso
*Attorney, Agent, or Firm*—James J. Leary

[57] ABSTRACT

A flexible lighting strip for producing a chasing light effect comprising:

an insulated three conductor wire

Light Emitting Diodes mounted by the memory of the wire insulation and oriented in such a manner that a four channel chase effect may be achieved with the use of only three conductors.

The system is of indefinite length and may be field cut or manufactured in finite length modules.

The strip may be surface mounted or installed in a suitable enclosure.

9 Claims, 2 Drawing Sheets

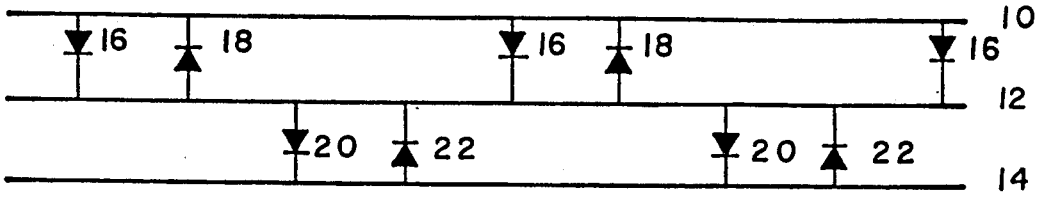
FIG. 1.
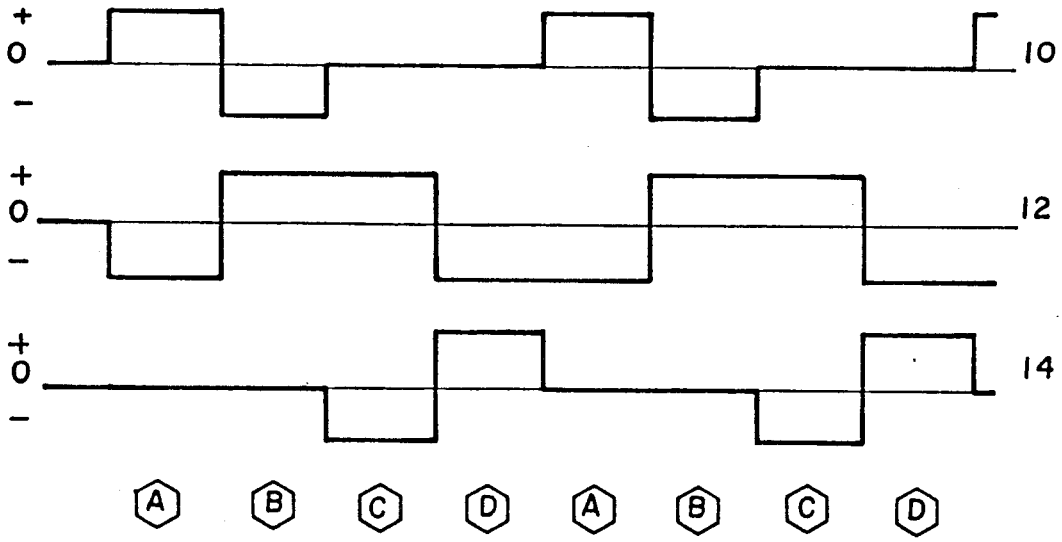
FIG. 2.
| CONDITION | L.E.D. LIT | STATE OF CONDUCTORS | | |
|---|---|---|---|---|
| | | NUMBER 10 | NUMBER 12 | NUMBER 14 |
| A | 16 | + VOLTAGE | − VOLTAGE | HIGH IMP |
| B | 18 | − VOLTAGE | + VOLTAGE | HIGH IMP |
| C | 20 | HIGH IMP | + VOLTAGE | − VOLTAGE |
| D | 22 | HIGH IMP | − VOLTAGE | + VOLTAGE |
FIG. 3.

STRIP LIGHTING SYSTEM USING LIGHT EMITTING DIODES

BACKGROUND OF THE INVENTION

1. Field of the Invention

This invention relates to a lighting system which produces either or both a static lighting effect and a chasing light effect. By chasing light effect is meant the optical illusion of moving light in a string or cascade of LED's. This type of lighting display produces a dynamic sensation and is particularly useful as background lighting in casinos, restaurants and other places of entertainment. The invention may also be use in public places to indicate direction of exits or displays. A full on (not chasing) effect may be achieved by running the chase sequence so fast that the human eye cannot perceive any flicker and it appears that the system is static and all on.

2. Description of the Prior Art

In all prior art with LED's, direct electrical current, (DC) is applied in one direction only and therefore a common return conductor is required for the system to operate (i.e. if a four channel system is constructed, five conductors are required; one to each set of LED's and one as a common return conductor).

The return conductor in these systems under full on condition i.e. not chasing, must be capable of handling the sum of the power supplied on the each of the other four conductors. It must therefore be larger or it will limit the practical length that can be run with any one electrical feed.

Systems using LED's have been designed but they all use a common return conductor and individual feed or supply conductors to each set of LED's to produce the chasing effect.

None of the prior art reverses the direction of the current in the electrical conductors to control which of the LED's are illuminated at a particular time. This is the reason that more complicated connectors and a greater number of conductors are required for a chasing effect in other systems.

Manufacturers caution against applying reverse voltage to LED's and some go so far as to recommend using a protective device to ensure that the LED can never experience this condition.

Accordingly, using reverse voltage to the LED's to achieve a four-channel chase with only three conductors represents a new and not obvious use of LED technology.

By using only three conductors and no common return, economical production is possible in continuous lengths exceeding 200 lineal feet.

Installation and replacement of LED's is easy and can be performed with a minimum of equipment. There is also extreme flexibility in the installation of the LED's along the length of the conductors.

This ensures that the product can be competitive with existing tape and tube light systems in the marketplace while offering benefits that no existing system offers.

Incandescent lights may be powered by either alternating current (AC) or direct current (DC) and systems which produce a chasing effect using incandescent lamps are in existence. However, these systems also use a common return conductor. Because a common return conductor is used in these systems, the capacity of the system is inherently limited in terms of the distance the conductors may be run. A five conductor system for four channels is also necessary in these applications.

U.S. Pat. No. 4,164,008 shows LED's in series soldered or welded to etched conductors, a common return conductor is indicated and there are no provisions to reverse the voltage to any of the LED's. This patent is directed towards the clothing market and only intended for use on garments.

U.S. Pat. No. 4,173,035 discloses LED's soldered to a flexible printed circuit board fabricated in layers and of discrete finite lengths. The conductors are etched and require that the LED's be soldered in place, limiting flexibility of lamp spacing and ease of replacement. This system requires five conductors for a four channel chase. At no time is reverse voltage applied to the LED's.

U.S. Pat. No. 4,263,640 shows an incandescent light source light chasing system. It uses a number of incandescent lamps in series attached to discrete wires. The use of four feed wires and a common return is essential to operation.

U.S. Pat. No. 4,908,743 shows a plastic insulator with conductors inserted into continuous slots where the legs of lamps or LED's may also be inserted. However some form of cover is required for any installation and a common return conductor is necessary. There is no mention of using reverse voltage to achieve any special effects.

U.S. Pat. No. 4,997,197 shows LED's mounted to the sides and end of skateboards. Provision is made for chasing/flashing but a common return is again required.

U.S. Pat. No. 4,950,958 shows a round tubular "rope" type incandescent elongate light strip. It is not suited for flat application to surfaces, uses incandescent lamps at fixed intervals, and requires a common return conductor for both static and chasing applications.

U.S. Pat. No. 5,027,037 shows a typical sequencing controller for a chasing light system using pulse width modulation to control dimming. Once again a common return conductor is required and there is no provision for changing the direction of voltage and current to achieve any special effects or control any specific lights.

SUMMARY OF THE INVENTION

A three conductor system using flat conductors and LED's to produce a chasing effect of lights while utilizing 40% fewer electrical conductors than existing systems and utilizing all of these conductors efficiently. This is accomplished by alternating positive voltage and negative voltage to the conductors at a preset speed or speeds.

BRIEF DESCRIPTION OF THE DRAWINGS

FIG. 1 shows an electrical schematic drawing of the placement of the LED's.

FIG. 2 shows the electrical condition which exists in each of the three conductors 10, 12 and 14 during the four channel chase (referred to here as Condition A, B, C or D).

FIG. 3 shows which of the LED's 16, 18, 20 and 22 are emitting light under each of the four operating conditions (A,B,C and D).

REFERENCE NUMBERS IN DRAWINGS

10 Flat conductor
12 Flat conductor
14 Flat conductor
16 Light emitting diode (LED)
18 Light emitting diode (LED)
20 Light emitting diode (LED)
22 Light emitting diode (LED)
24 Flexible plastic insulator

DETAILED DESCRIPTION OF THE INVENTION

In FIG. 1, an electrical schematic shows the required orientation of the LED anodes and cathodes necessary to produce the four channel chasing effect.

Figure 5:
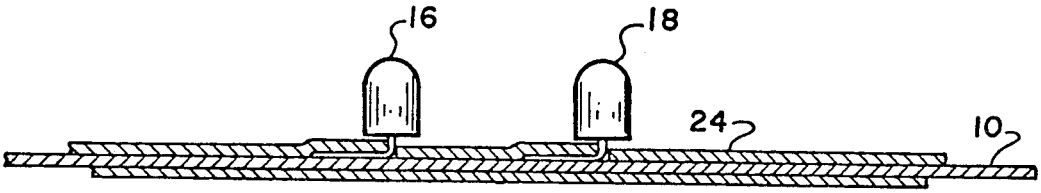
FIG. 5 shows a longitudinal cross section of the conductor's with the LEDs installed and held in place by the memory of the protective insulating casing 24.

The anodes and cathodes of all LED's are bent at right angles to the body of the LED, (as shown in FIG. 5) in such a manner that the anode of LED 16, when inserted into the insulation 24, is held in contact with conductor 10. The cathode of LED 16 is then held in contact with conductor 12.

This means that LED 16 will emit light when conductor 10 has positive voltage applied it with respect to conductor 12.

LED 18 has the anode and cathode bent in the opposite direction to the anode and cathode of LED 16 so that when LED 18 is inserted into the insulation 24 from the same direction as LED 16 the anode of LED 18 is held in contact with conductor 12 and the cathode of LED 18 is held in contact with conductor 10. This means that LED 18 will emit light when conductor 12 has positive voltage applied to it with respect to conductor 10.

LED 20 has the anode and cathode bent in the same direction as those of LED 16. The anode is held in contact with conductor 12 and the cathode is held in contact with conductor 14. This means that LED 20 will emit light when conductor 12 has positive voltage applied to it with respect to conductor 14.

LED 22 has the anode and cathode bent in the same direction as the anode and cathode of LED 18. When inserted into the insulation 24, the anode is held in contact with conductor 14 and the cathode is held in contact with conductor 12. This means that LED 22 will emit light when conductor 14 has positive voltage applied to it with respect to conductor 12.

In FIG. 2 the electrical condition which exists in each of the three conductors 10. 12 and 14 during the four channel chase sequence is shown. This indicates the relative electrical potential difference between the conductors 10, 12 and 14 and controls which of the four LED's 16, 18, 20 or 22 are emitting light for any part of the chase sequence.

In Condition A, conductor 10 has positive voltage applied to it and conductor 12 acts as a return with negative potential with respect to conductor 10. Conductor 14 is in a state of high impedance or isolation from the power supply. In Condition A, the only LED that is conducting power is LED 16 and therefore the only LED that emits light is LED 16.

In Condition B, conductor 10 now acts as a return with negative potential with respect to conductor 12. Conductor 12 has positive voltage applied to it. This causes LED 16 to stop emitting light and LED 18 to begin emitting light as current passes from conductor 12 to Conductor 10. Conductor 14 is still in a state of high impedance or isolation from the power supply. In Condition B, the only LED conducting power is LED 18 and therefore the only LED that emits light is LED 18.

In Condition C, conductor 12 remains in the condition of having positive voltage applied to it. Conductor 14 now acts as a return with negative potential with respect to conductor 12. This causes LED 18 to stop emitting light and LED 20 to begin emitting light as current passes from Conductor 12 to Conductor 14.

Conductor 10 is in a state of high impedance or isolation from the power supply. In Condition C, the only LED conducting power is LED 20 and therefore the only LED that emits light is LED 20.

In Condition D, conductor 12 now acts as a return with negative potential with respect to Conductor 14. This causes LED 20 to stop emitting light and LED 22 to begin emitting light as current passes from Conductor 14 to Conductor 12. Conductor 1 0 is still in a state of high impedance or isolation from the power supply. In Condition D, the only LED conducting power is LED 22 and therefore the only LED that emits light is LED 22.

These four conditions repeat continuously and, as can be seen from the arrangement of LED's 16, 18, 20 and 22, the LED's appear to move along the conductors 10, 12 and 14.

The arrangement of the LED's is repeated along the conductor's for as long a distance as is practicable with the components and spacing used.

In FIG. 3 a matrix form of FIGURE I and FIG. 2 shows more clearly which LED is emitting light in each condition outlined in FIG. 2. It also shows the relative potential of the conductors with respect to each other and the LED's that are emitting light under each condition.

Figure 4:
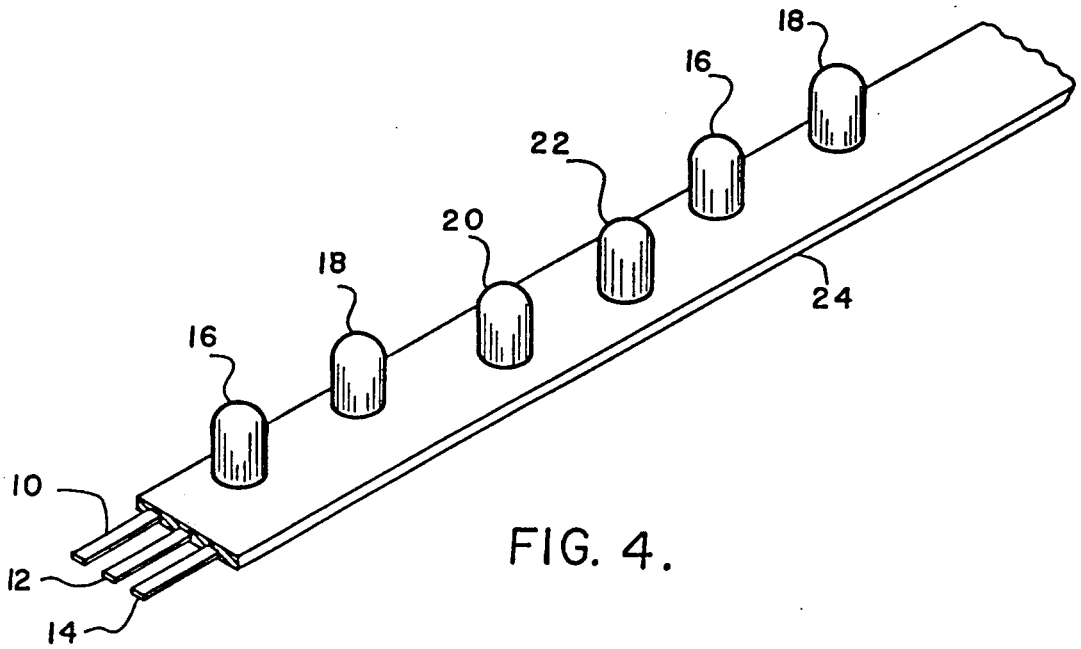
FIG. 4 shows a typical isometric view of a section of the three conductor wire with the LED's 16, 18, 20 and 22 installed along the three conductors 10, 12 and 14.

FIG. 4 is an isometric view showing the relative placement of the LED's 16, 18, 20 and 22 with respect to the conductors 10, 12 and 14. LED's 16 and 18 are shown as being installed with their legs, (anodes and cathodes) on conductors 10 and 12. LED's 20 and 22 are shown as being installed with their anodes and cathodes on conductors 12 and 14. All LED's are shown with the light emitting portion of the diode being situated on top of the protective casing 24.

The protective insulating casing or cover 24 is made of a flexible elastomer, such as PVC.

The flexible PVC insulation 24 is extruded onto the flat copper conductors 10, 12, and 14. It then acts as an insulator and maintains the conductors 10, 12, and 14 in the correct spatial relationship to each other for placement of the LED's 16, 18, 20 and 22.

Because PVC will not adhere to the copper conductors it is a relatively simple matter to pierce the insulating cover 24 at each point that is required to mount an LED and then insert the LED in the correct orientation for the chasing sequence to be maintained.

Conductors 10, 12 and 14 are connected to either a mechanical or electronic sequencing device to produce the required electrical conditions necessary for operation of the system.

FIG. 5 shows a longitudinal section of the system wherein the conductor 10 is encased in the insulating PVC cover 24 with the anode of LED 16 and the cathode of LED 18 inserted through the insulation 24 from the same direction and slid along the top of conductor 10.

FIG. 5 also shows how the "memory" of the PVC insulator 24 holds the anode of LED 16 and the cathode of LED 18 in electrical contact with conductor 10.

This means of assembly makes for simple and economical manual or automated production with the ability to vary spacing to suit any project needs. It does not require expensive or complicated equipment to manufacture the system or to field modify the system.

Reversing the bend direction of alternate LED anodes and cathodes allows the LED's to all be inserted from the same direction with respect to the insulation 24 and conductors 10, 12 and 14.

It would however be possible to bend the anodes and cathodes of all LED's in the same relative direction and achieve the same overall result by reversing the insertion direction of the LED's through the insulator 24.

Figure 6:
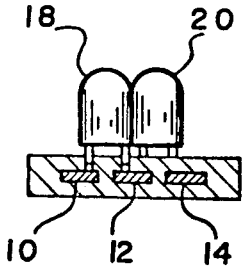
FIG. 6 shows a cross section of the conductors and the LED's.

In FIG. 6, (a cross section of the system), conductors 10,12, and 14 are shown in relationship to LED's 18 and 20. LED's 18 and 20 are held in place with the insulation 24. It can be seen that the spacing of the conductors 10,12 and 14 is such that the anode of LED 18 is held in contact with conductor 12 and the cathode of LED 18 is held in contact with conductor 10 by the insulator 24. The anode of LED 20 is held in contact with conductor 12 and the cathode of LED 20 is held in contact with conductor 14 by the insulator 24. This ensures that the proper electrical contact is maintained between the LED's and the conductors.

Because the LED's are held in place by piercing the insulation 24 wherever an LED is required and inserting the anode and cathode of the LED parallel to and directly on top of the conductors, it is a simple matter to vary the spacing of the LED's along the conductors. Should an LED ever fail in service it may be replaced in the field without the need for specialized tools.

The finished assembly may be surface mounted by clips or double sided tape or a suitable adhesive, or encased in either flexible or rigid clear plastic tubing of various shapes and sizes.

It may also be encased in a poured clear plastic resin where future access is of lesser importance than protection, such as a floor or cleanroom environment or other applications which would be obvious to those practiced in the art.

Supplying power to the system is accomplished with commercially available connections designed for use with flat tape data transmission products.

I claim:

1. A circuit for sequential illumination of light emitting diodes comprising:

a first electrical conductor, a second electrical conductor, a third electrical conductor, and at least four light emitting diodes, including:

a first light emitting diode, said first light emitting diode being electrically connected between said first electrical conductor and said second electrical conductor, said first light emitting diode having a directional bias which allows electrical current to flow through said first light emitting diode from said first electrical conductor to said second electrical conductor and which prevents electrical current from flowing through said first light emitting diode from said second electrical conductor to said first electrical conductor, a second light emitting diode, said second light emitting diode being electrically connected between said first electrical conductor and said second electrical conductor, said second light emitting diode having a directional bias which allows electrical current to flow through said second light emitting diode from said second electrical conductor to said first electrical conductor and which prevents electrical current from flowing through said second light emitting diode from said first electrical conductor to said second electrical conductor, a third light emitting diode, said third light emitting diode being electrically connected between said second electrical conductor and said third electrical conductor, said third light emitting diode having a directional bias which allows electrical current to flow through said third light emitting diode from said second electrical conductor to said third electrical conductor and which prevents electrical current from flowing through said third light emitting diode from said third electrical conductor to said second electrical conductor, a fourth light emitting diode, said fourth light emitting diode being electrically connected between said second electrical conductor and said third electrical conductor, said fourth light emitting diode having a directional bias which allows electrical current to flow through said fourth light emitting diode from said third electrical conductor to said second electrical conductor and which prevents electrical current from flowing through said fourth light emitting diode from said second electrical conductor to said third electrical conductor.

2. The circuit of claim 1, wherein said first, second and third electrical conductors are aligned substantially parallel to one another and said at least fourth light emitting diodes are arranged sequentially along said first, second and third electrical conductors in the following order; said first light emitting diode, followed sequentially by said second light emitting diode, followed sequentially by said third light diode, followed sequentially by said fourth light emitting diode.

3. The circuit of claim 1, wherein said first, second and third electrical conductors are encased in a plastic insulator and said at least four light emitting diodes each have two electrodes, said light emitting diodes being electrically connected to said electrical conductors by piercing said two electrodes through said plastic insulator such that said two electrodes contact said electrical conductors.

4. The circuit of claim 3, wherein said plastic insulator comprises a resilient plastic and wherein said electrodes are inserted between said resilient plastic and said electrical conductors, the resilience of said plastic insulator holding said electrodes in electrical contact with said electrical conductors.

5. The circuit of claim 1, further comprising a switching means, said switching means having at least four operative states, including:

a first operative state in which said first electrical conductor is connected to a positive electrical potential, said second electrical conductor is connected to a negative electrical potential, and said third electrical conductor is in a high impedance state, a second operative state in which said first electrical conductor is connected to a negative electrical potential, said second electrical conductor is connected to a positive electrical potential, and said third electrical conductor is in a high impedance state, a third operative state in which said first electrical conductor is in a high impedance state, said second electrical conductor is connected to a positive electrical potential, and said third electrical conductor is connected to a negative electrical potential, a fourth operative state in which said first electrical conductor is in a high impedance state, said second electrical conductor is connected to a negative electrical potential, and said third electrical conductor is connected to a positive electrical potential.

6. The circuit of claim 5 wherein said switching means further comprises a sequencing means for sequentially switching said switching means from said first operative state to said second operative state to said third operative state to said fourth operative state.

7. A circuit for sequential illumination of light emitting diodes comprising:

a first electrical conductor, a second electrical conductor, a third electrical conductor, said first, second and third electrical conductors being aligned substantially parallel to one another, and a multiplicity of light emitting diodes linearly arranged along said electrical conductors, said multiplicity of light emitting diodes being arranged in repeating units of four light emitting diodes, each of said repeating units of four light emitting diodes comprising:

a first light emitting diode, said first light emitting diode being electrically connected between said first electrical conductor and said second electrical conductor, said first light emitting diode having a directional bias which allows electrical current to flow through said first light emitting diode from said first electrical conductor to said second electrical conductor and which prevents electrical current from flowing through said first light emitting diode from said second electrical conductor to said first electrical conductor, a second light emitting diode, said second light emitting diode being electrically connected between said first electrical conductor and said second electrical conductor, said second light emitting diode having a directional bias which allows electrical current to flow through said second light emitting diode from said second electrical conductor to said first electrical conductor and which prevents electrical current from flowing through said second light emitting diode from said first electrical conductor to said second electrical conductor, a third light emitting diode, said third light emitting diode being electrically connected between said second electrical conductor and said third electrical conductor, said third light emitting diode having a directional bias which allows electrical current to flow through said third light emitting diode from said second electrical conductor to said third electrical conductor and which prevents electrical current from flowing through said third light emitting diode from said third electrical conductor to said second electrical conductor, a fourth light emitting diode, said fourth light emitting diode electrically connected between said second electrical conductor and said third electrical conductor, said fourth light emitting diode having a directional bias which allows electrical current to flow through said fourth light emitting diode from said third electrical conductor to said second electrical conductor and which prevents electrical current from flowing through said fourth light emitting diode from said second electrical conductor to said third electrical conductor.

8. The circuit of claim 7, further comprising a switching means, said switching means having at least four operative states, including:

a first operative state in which said first electrical conductor is connected to a positive electrical potential, said second electrical conductor is connected to a negative electrical potential, and said third electrical conductor is in a high impedance state, a second operative state in which said first electrical conductor is connected to a negative electrical potential, said second electrical conductor is connected to a positive electrical potential, and said third electrical conductor is in a high impedance state, a third operative state in which said first electrical conductor is in a high impedance state, said second electrical conductor is connected to a positive electrical potential, and said third electrical conductor is connected to a negative electrical potential, a fourth operative state in which said first electrical conductor is in a high impedance state, said second electrical conductor is connected to a negative electrical potential, and said third electrical conductor is connected to a positive electrical potential.

9. The circuit of claim 8, wherein said switching means further comprises a sequencing means for sequentially switching said switching means from said first operative state to said second operative state to said third operative state to said fourth operative state.

* * * * *